US006361001B1

(12) United States Patent
Durand

(10) Patent No.: US 6,361,001 B1
(45) Date of Patent: Mar. 26, 2002

(54) CONTAINER HOLDER

(76) Inventor: Mark Roger Durand, 13572 49$^{th}$ St., Royal Palm Beach, FL (US) 33411

( * ) Notice: Subject to any disclaimer, the term of this patent is extended or adjusted under 35 U.S.C. 154(b) by 0 days.

(21) Appl. No.: 09/589,969

(22) Filed: Jun. 8, 2000

(51) Int. Cl.$^{7}$ ..... A47G 23/02

(52) U.S. Cl. ..... 248/146; 248/198; 248/213.2; 248/505

(58) Field of Search ..... 248/146, 500, 248/505, 213.2, 149, 152

(56) References Cited

U.S. PATENT DOCUMENTS

| | | | | | |
|---|---|---|---|---|---|
| 279,238 | A | * | 6/1883 | Geiger | 126/30 |
| 825,248 | A | * | 7/1906 | Silver | 248/148 |
| 1,338,106 | A | * | 4/1920 | Smith | 248/128 |
| 2,513,630 | A | * | 4/1950 | Elliott | 248/147 |
| 2,539,581 | A | * | 1/1951 | Holden | 439/372 |
| 2,576,832 | A | * | 11/1951 | Gibson | 248/149 |
| 3,201,075 | A | * | 8/1965 | Sievers | 248/147 |
| 4,396,291 | A | | 8/1983 | Simmonds | |
| 4,422,770 | A | | 12/1983 | Geible | |
| 4,538,922 | A | | 9/1985 | JOhnson | |
| 4,926,390 | A | | 5/1990 | Murzsa et al. | |
| D320,930 | S | | 10/1991 | Stallings | |
| 5,232,188 | A | * | 8/1993 | Troncone | 248/154 |
| 5,251,979 | A | | 10/1993 | Larsen | |
| 5,590,861 | A | * | 1/1997 | Ardolino | 248/146 |
| 5,632,460 | A | * | 5/1997 | Strickland | 248/146 |
| 5,924,659 | A | * | 7/1999 | Babcock | 248/146 |

* cited by examiner

*Primary Examiner*—Anita King
*Assistant Examiner*—Naschica S Morrison
(74) *Attorney, Agent, or Firm*—McHale & Slavin

(57) ABSTRACT

The instant invention is a container holder for mixing slurry material in a 2½ or 5 gallon bucket. The container holder is formed from a one-piece raised top portion having a centrally disposed aperture allowing insertion of a stirring paddle. Depending from the top portion are two legs that extend downwardly and span the entire height of the bucket to be mixed with foot pads joined at the bottom of the legs extending outwardly therefrom which allow an individual to stand on during the mixing operation.

19 Claims, 3 Drawing Sheets

CONTAINER HOLDER

FIELD OF THE INVENTION

This invention is directed to the field of construction and, in particular, to a portable device that provides a means for holding a container stationary while the contents of the container are mixed.

BACKGROUND OF THE INVENTION

Modern construction materials used for various construction trades such as tiling, drywall, ceilings, concrete, spraydeck, paint, driveway sealing, floor levelers, and resins are typically prepared at a job site. These construction jobs require point-of-use mixing or remixing of premixed materials that may have separated during shipping or long term storage. The problem exists when mixing is attempted of thick slurry materials.

By way of example, a job may require small amounts of stucco material to be prepared for wall patching. Stucco material is basically a cement mix and is prepared by mixing water to a dry cement mix. For convenience, mixing of such materials is typically performed in a container such as a 2 ½ or 5 gallon bucket. Currently, such materials are mixed manually by use of a stirring stick or by use of a power operated device having a paddle type stirrer. Profession tradesmen can ill afford the time it takes to mix such materials by a hand stirrer and commonly employ a power operated device which can be unwieldy if the container is not properly secured. In operation, a worker will stand on the rim of the bucket and engage the power stirrer. Standing on the rim is most dangerous should the operator slip or the bucket break. Further, if the bucket is overfilled the centrifugal force created by the stirring action will result in spillage and wasted manpower for clean-up. Still further, typically a second person is required to add ingredient while the first person is mixing for efficiency, yet the use of a second man again wastes manpower.

For this reason numerous items have been patented in an attempt to provide an efficient and cost effective means for mixing of materials with minimal spillage. U.S. Pat. No. 4,396,291 discloses a motored driven paint mixer mounted to a conventional container by use of a bracket. The electric mixer provides an automated means for liquefying the container contents but fails to provide a convenient means of mixing all of the material as the angle of mixing is fixed. Further, the bracketry is designed for a specialty motor and does not take into account the need for mixing slurry materials wherein the mixer will "walk" as it is not secured to the container.

U.S. Pat. No. 4,926,390 discloses a paint mixer which is capable of mixing the entire contents of the container by use of an enlarged propeller. However, the device provides no mechanism for securing the container during the mixing process. Thus, should a slurry be mixed the container will spin unless properly weighted or otherwise held to the ground. In such instances, an individual may need to hold the container while another individual mixes the material. If the individual is alone, he will need to improvise by placing weights on the top of the container or even standing on it to prevent it from spinning.

U.S. Pat. No. 4,422,770 discloses yet another paint stirrer which in this embodiment consists of a modified cap with an attachment for a drill handle. This device provides a means for mixing but fails to provide a means of rotating the container.

Yet another example of mixing devices is found in U.S. Pat. No. 5,251,979 wherein yet another paint container has a modified cover having a coupling for attachment to an electric drill. Similar concepts are disclosed in U.S. Pat. Nos. 4,538,922 and D320,938.

What the prior art fails to disclose is that should the contents of the container be in a state of difficult mixture, then the ability to cause the materials to be mixed therein is dependent upon the ability of the operator to prevent the container from rotating during the mixing operation. As previously stated, an operator may need to stand on the container or otherwise wedge it between their legs in an effort to prevent the container from rotating. As it would be expected, a mixture of sand and cement provide significant resistance to a mixing apparatus until a state of liquidity occurs.

Thus, what is lacking in the art is an apparatus or device capable of securing a container in a fixed position by employing the weight of the operator yet further allowing ease of access to the container without modification thereto, and being of such size to allow for ease of container content liquidity.

SUMMARY OF THE INVENTION

The instant invention is a container holder adaptable to 2 ½ and 5 gallon buckets, the buckets being defined as having a circular bottom with a continuous side wall forming an interior section. The instant invention includes a one-piece raised top portion having a centrally disposed aperture. Depending from the top portion are two legs that extend downwardly from the top of the bucket so as to span the entire height with foot pads joined at the bottom of the legs extending outwardly therefrom.

In operation, an individual places the instant invention over the rim of the bucket and adjusts the foot pads to be flush with the support surface. The legs are sized so as to cause engagement of the rim by the top portion when the foot pads are stepped on. In one embodiment, the weight of the individual engages the container rim so as to hold the container in a fixed ridged position. Materials can be added to the container and an electric mixing mechanism inserted through the aperture allow mixing of the materials therein.

In an alternative embodiment of the invention, the legs depending from the top portion frictionally engage the sidewall of the bucket for purposes of maintaining the bucket in a fixed position. The legs may include an inner surface which is curved to follow the surface of the bucket further providing a positioning/alignment operation. To accommodate different size buckets the legs are adjustable. For storage the legs can be retracted or hinged allowing the legs to fold inward.

In a preferred embodiment, the top of the bucket is notched by use of a razor, knife, or snipes. Placement of a notch on opposing side surfaces provides a stable engagement. Engagement tabs located along a lower surface of the top portion are inserted into the prepared notches and prevent rotation of the container when the foot pads have applied weight.

Thus an objective of the instant invention is to provide a container holder capable of maintaining a mixing bucket in a fixed position despite the consistency of the materials to be mixed.

Another objective of the instant invention is to provide a device that is adaptable to different size containers having a bubblous top that conforms to the size of various bucket openings and adjustable legs to accommodate various heights.

Another objective of the instant invention is to provide an engagement means for locking of a bucket in a position, the engagement means being either a locking mechanism such as tabs for engaging the rim of a bucket or side mounted tabs placed along the inner surface of the legs to prevent rotation thereof.

Still another objective of the instant invention is to provide a raised conical shape to prevent spillage by providing an area of expansion during a fast mixing process. Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
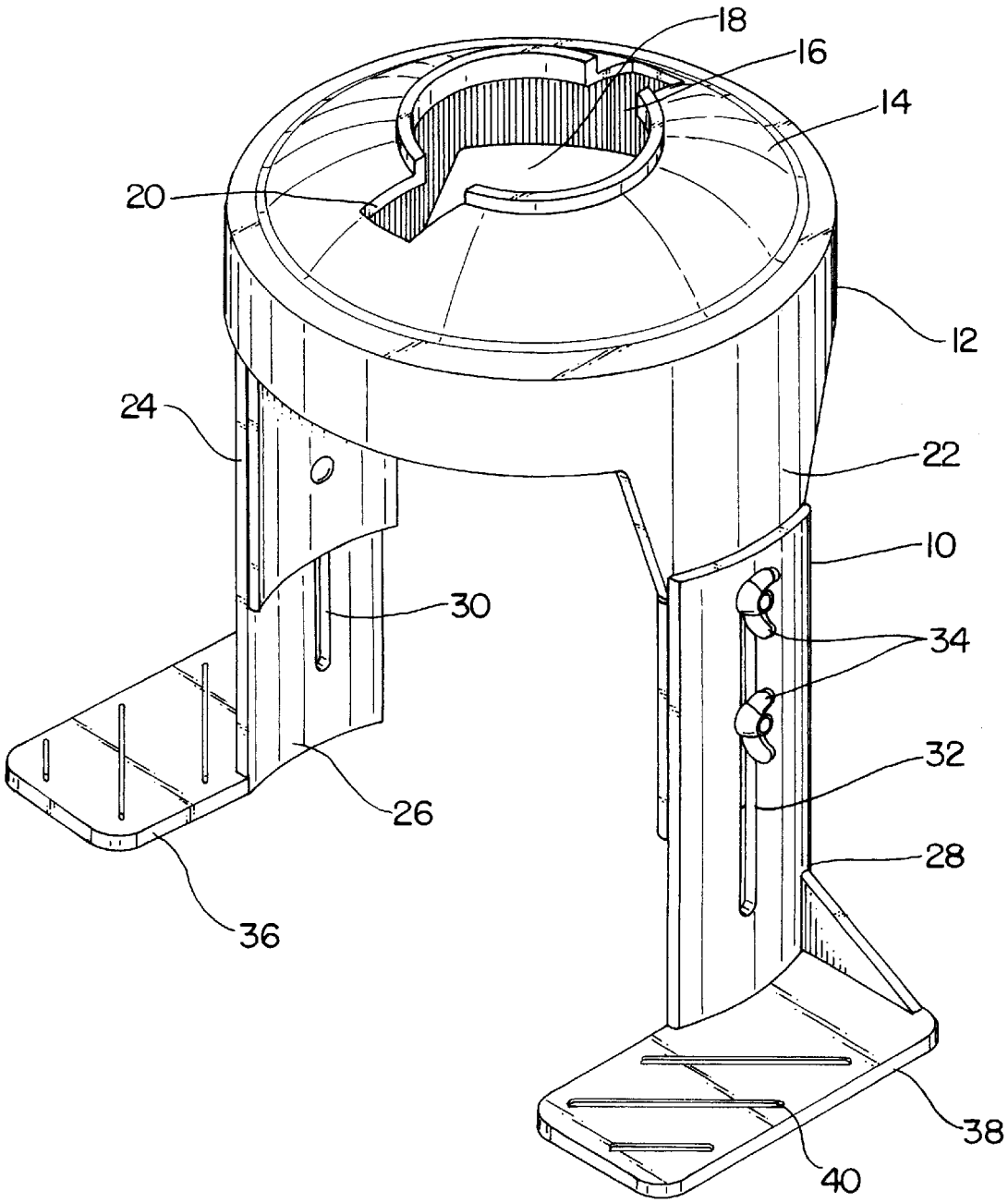
FIG. 1 is a perspective view of the container holder of the instant invention.

Now referring to FIG. 1 wherein a perspective view of the container holder 10 is depicted, it is noted that the container holder 10 has a particular application for 2 ½ and 5 gallon buckets. A conventional bucket being defined as having a bottom with a continuous side wall forming an interior area for containment of liquids. The container holder 10 consists of a top portion 12 formed from a rigid material such as plastic or metal having an upper surface 14 and a lower surface 16. The lower surface is positionable over the rim of a bucket providing either frictional engagement to the rim or locking engagement should notches be placed into the rim of the bucket. The preferred securement employs the notches using engagement tabs, described later in this specification. These engagement tabs operate to secure a bucket in a fixed position during a mixing of a heavy slurry such as cement.

The top portion 12 includes an aperture 18 which allows insertion of a stirring mechanism for use in mixing materials placed in the bucket. The aperture 18 opening is approximately six inches in diameter with side wall slots 20 allowing receipt of an eight inch stirrer paddle. The top portion 12 includes leg support 22 and 24 for securement of adjustable legs 26 and 28. The adjustable leg 26 includes an attachment slot 30, similar to adjustable leg 28 having attachment slot 32, for receipt of bolt/nut combination 34 allowing for height adjustments. Adjustable legs 26 and 28 include a foot pad allowing the weight of an individual to maintain the top portion 12 in a fixed position. The foot pads 36 and 38 include ribs 40 to provide a friction surface or otherwise include a surface capable of providing a secure platform for which to stand on during the mixing process.

Figure 3:
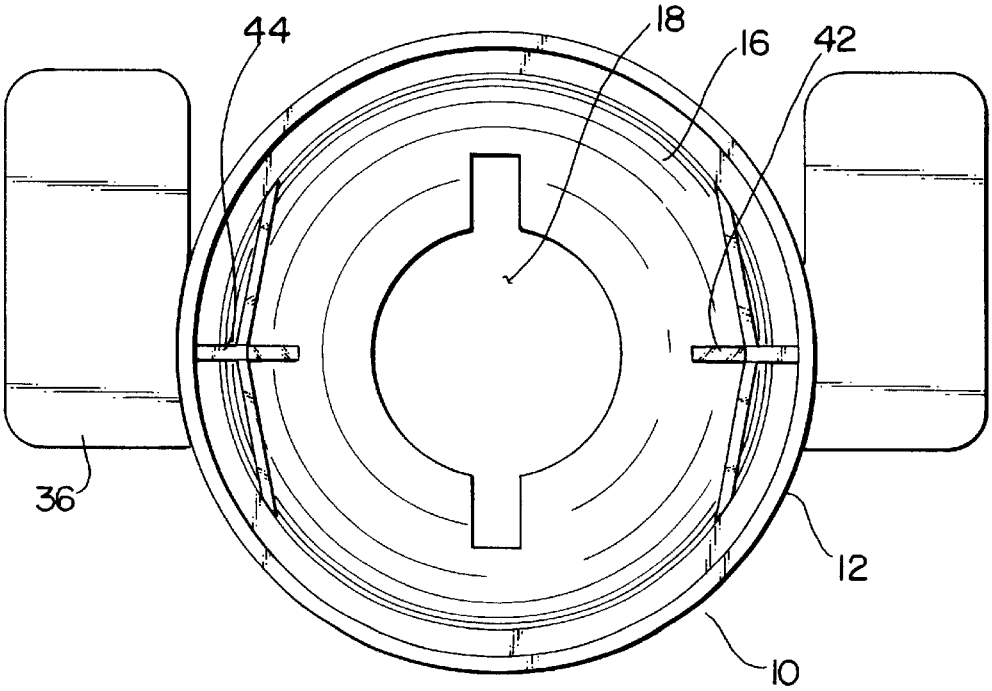
FIG. 3 is a bottom view thereof.

Referring now to FIG. 3 a bottom view of the container holder 10 is depicted. Inner surface 16 is depicted with engagement tabs 42 and 44 available for securing to the notched rim of a bucket, not shown. In operation, a bucket that is to be used requires a reciprocal notch to be cut into the rim of the bucket wherein engagement tabs 42 and 44 would reside within the cutout thereby providing secure means of bucket retention capable of stopping the rotation of a bucket while a heavy slurry is being mixed. The conical shape of the top portion 12 lessens by providing a direction for splashed material to be funneled back into the container.

Figure 2:
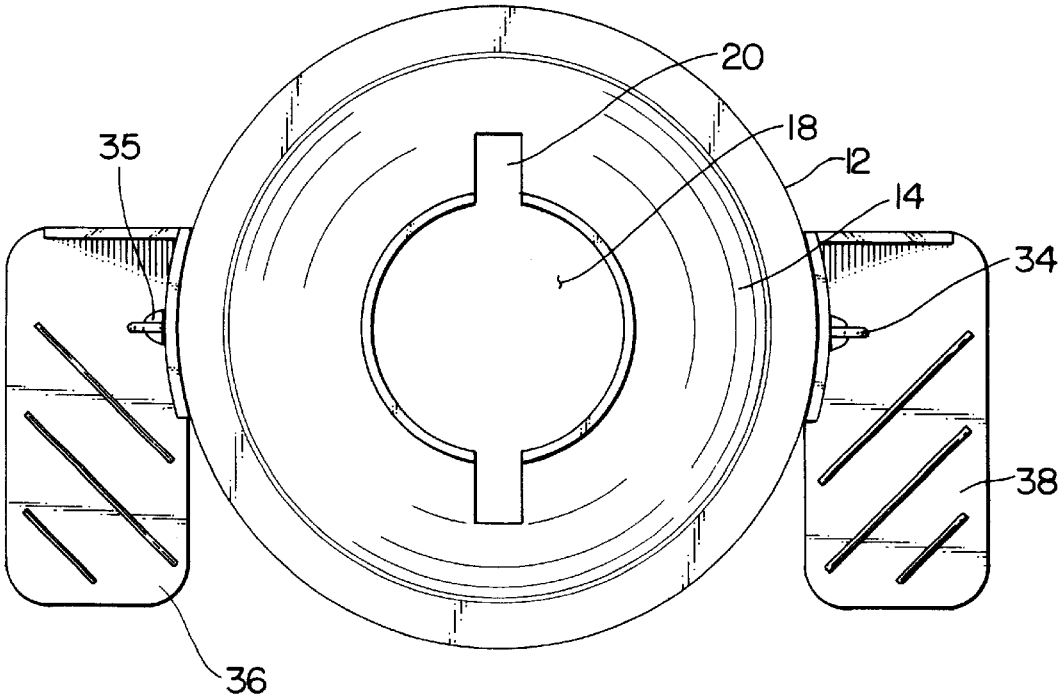
FIG. 2 is a top view of said container holder.

As shown in FIG. 2, the top portion 12 of the container is circular in shape to encompass a conventional bucket. The bolt/nut 34, 35 having a wingnut does not interfere with the foot pads 36 and 38. It should be noted that only one engagement bolt may be necessary for maintaining the adjustment legs in position if a second bolt is replaced with an alignment peg, engagement slot, or the like alignment mechanism. The legs 26 and 28 may also be hinged 46 (see FIG. 4) allowing the legs to fold inward for purposes of storage wherein the device would consume a minimal amount of space.

Figure 4:
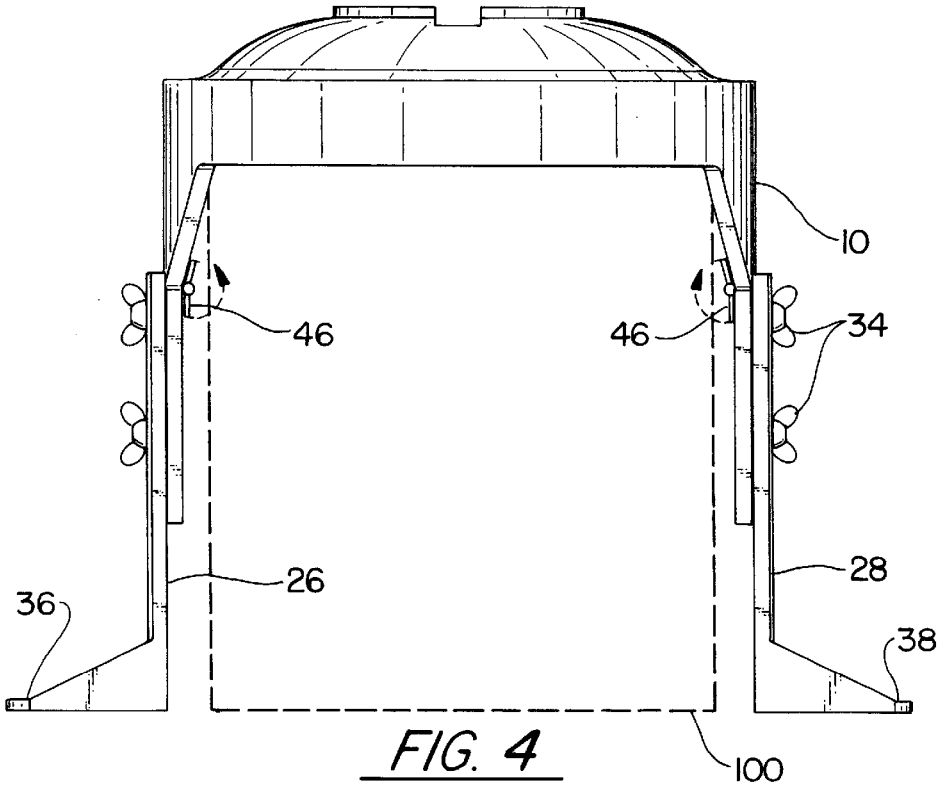
FIG. 4 is a front view of the container holder.
Figure 5:
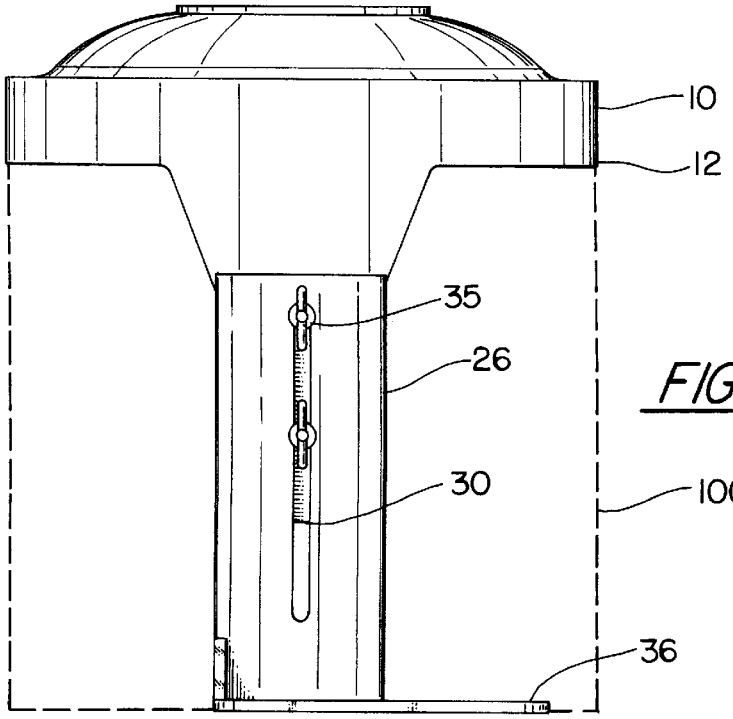
FIG. 5 is a side view thereof.

FIGS. 4 and 5 depict the front and side views of the container holder 10 demonstrating the placement of a bucket 100 in a secured position. As previously mentioned, the container holder 10 has a particular application for 2 ½ and 5 gallon buckets 100. The container holder 10 consists of a top portion 12 formed from a rigid material having an upper surface 14 and a lower surface positionable over the rim of the bucket 100. The top portion 12 includes leg support 22 and 24 for securement of adjustable legs 26 and 28. Adjustable legs 26 and 28 each include a hinge 46, which by way of example, is shown at the top of the legs (arrows demonstrate inward folding allowed by hinge 46), however alternative placement of hinge 46 is contemplated by the invention. The adjustable leg 26 includes an attachment slot 30 for receipt of bolt/nut combination allowing for height adjustments. Adjustable legs 26 and 28 include a foot pad allowing the weight of an individual to maintain the top portion 12 in a fixed position. The foot pads 36 and 38 include ribs 40 to provide a friction surface or otherwise include a surface capable of providing a secure platform for which to stand on during the mixing process.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A container holder for a container having a bottom joined to a continuous sidewall extending upward therefrom to form a rim, said bottom and sidewall having an inner surface and an outer surface, said inner surface forming an interior area available for the containment of liquids, said container holder comprising:

a circular shaped bubble top portion formed from a piece of rigid material having an upper surface and a lower surface, said lower surface adapted to be positionable over said interior area of said container, said top portion including an aperture sized for insertion of a stirring mechanism for use in mixing materials placed in said interior area;

at least two legs joined to said top portion and depending downwardly therefrom, said legs adapted to be juxtapositioned along said outer surface of said container sidewall and each of said legs including a footpad extending outwardly therefrom, said legs adjustable in length; and a means for engaging said container;

whereby said container holder is positionable over the top of said container with said footpads available for standing thereon, wherein a stirrer is positionable within said interior area for mixing of liquids and wherein the weight of a user placed on the footpads permits engagement of the container holder with said rim of said container to prevent rotation there of.

2. The container holder according to claim 1 wherein said top portion is circular in shape.

3. The container holder according to claim 1 wherein said top portion includes engagement tabs securable to said rim.

4. The container holder according to claim 1 wherein said legs include a means for engaging said outer surface of side wall of said container.

5. The container holder according to claim 1 wherein said aperture is approximately six inches.

6. The container holder according to claim 5 wherein said aperture includes a cut-out for insertion of a paddle type stirrer.

7. The container holder according to claim 1 wherein said top portion is raised and conical shaped to lessen spillage.

8. The container holder according to claim 1 wherein said footpads include a friction surface.

9. The container holder according to claim 8 wherein said friction surface is raised tabs.

10. The container holder according to claim 1 wherein said top portion and said legs are constructed of unitary plastic material.

11. A container holder for a container having a bottom joined to a continuous sidewall extending upward therefrom to form a rim, said bottom and sidewall having an inner surface and an outer surface, said inner surface forming an interior area available for the containment of liquids, said container holder comprising:

a circular shaped bubble top portion formed from a piece of rigid material having an upper surface and a lower surface, said lower surface adapted to be positionable over an interior area of a container, said top portion including an aperture sized for insertion of a stirring mechanism for use in mixing materials placed in said interior area;

at least two legs joined to said top portion and depending downwardly therefrom, said legs adapted to be juxtapositioned along an outer surface of a container sidewall and each said legs including a footpad extending outwardly therefrom, said legs adjustable in length; and means engageable with a container;

whereby said container holder is positionable over the top of a container with said footpads available for standing thereon, and wherein a stirrer is positionable within said interior area for mixing of liquids with the weight of a user placed on the footpads engageable with a rim of a container to prevent rotation thereof.

12. The container holder according to claim 11 wherein said top portion includes a means for engaging said rim.

13. The container holder according to claim 11 wherein said legs include a means for engaging said outer surface of a side wall of said container.

14. The container holder according to claim 11 wherein said aperture is approximately six inches in diameter.

15. The container holder according to claim 11 wherein said top portion is approximately 13 inches in diameter.

16. The container holder according to claim 11 wherein said footpads include a friction surface.

17. The container holder according to claim 16 wherein said friction surface is raised tabs.

18. The container holder according to claim 11 wherein said top portion and said legs are constructed of unitary plastic material.

19. The container holder according to claim 11 wherein said legs are hinged allowing said legs to fold inward for compact storage when not in use.

* * * * *